US007987991B2

(12) United States Patent
Piper et al.

(10) Patent No.: US 7,987,991 B2
(45) Date of Patent: Aug. 2, 2011

(54) PULPER WITH SCREEN PLATE HAVING MAXIMUM DEFIBERING EDGES

(75) Inventors: Michael Piper, Appleton, WI (US); Robert J. Matz, Appleton, WI (US)

(73) Assignee: Voith Patent GmbH, Heidenheim (DE)

( * ) Notice: Subject to any disclaimer, the term of this patent is extended or adjusted under 35 U.S.C. 154(b) by 708 days.

(21) Appl. No.: 11/512,852

(22) Filed: Aug. 30, 2006

(65) Prior Publication Data

US 2008/0053874 A1 Mar. 6, 2008

(51) Int. Cl.
*B07B 1/49* (2006.01)

(52) U.S. Cl. ..... 209/397; 209/358

(58) Field of Classification Search ..... 209/10, 209/268, 270, 273, 300, 306, 397, 399, 351, 209/352, 358, 363, 398
See application file for complete search history.

(56) References Cited

U.S. PATENT DOCUMENTS

| | | | | |
|---|---|---|---|---|
| 3,150,038 | A | 9/1964 | Rich | |
| 4,563,270 | A * | 1/1986 | Wolff | 209/379 |
| 4,832,834 | A * | 5/1989 | Baird, Jr. | 209/397 |
| 5,064,537 | A * | 11/1991 | Chupka et al. | 210/497.01 |
| 5,798,025 | A * | 8/1998 | Iwashige | 162/261 |
| 5,836,531 | A * | 11/1998 | Maybon | 241/296 |
| 6,254,729 | B1 * | 7/2001 | Doelle et al. | 162/251 |
| 6,571,957 | B1 * | 6/2003 | Doelle et al. | 209/273 |
| 6,623,572 | B2 * | 9/2003 | Doelle et al. | 148/527 |

FOREIGN PATENT DOCUMENTS

| | | |
|---|---|---|
| EP | 0 479 203 A1 | 4/1992 |
| GB | 659111 | 10/1951 |
| WO | 90/10110 A1 | 9/1990 |
| WO | 98/49392 A1 | 11/1998 |

OTHER PUBLICATIONS

Communication dated Dec. 20, 2007 from European Patent Office including European Search Report (dated Dec. 4, 2007) and European search opinion for application No. 07 015 571.8-2314 (7 pages).
Communication dated Oct. 29, 2010 from European Patent Office for application No. 07 015 571.8-2314 (4 pages).
Document (titled "Begleitschreiben fuer nachgereichte Unterlagen") dated Nov. 23, 2010 from European Patent Office for application No. 07 015 571.8-2314 (5 pages).
Communication dated Dec. 9, 2010 from European Patent Office for application No. 07 015 571.8-2314 (2 pages).

* cited by examiner

*Primary Examiner* — Joseph C Rodriguez
*Assistant Examiner* — Kalyanavenkateshware Kumar
(74) *Attorney, Agent, or Firm* — Taylor IP, PC

(57) ABSTRACT

A screening machine for a fiber suspension includes a vessel; a rotor disposed within the vessel; and a screen plate positioned in stationary opposition to the rotor. The screen plate includes a plurality of substantially parallel first grooves extending in a first direction and a plurality of substantially parallel second grooves extending in a second direction. The first grooves intersect with the second grooves. The first grooves and the second grooves conjunctively define a plurality of lands and depressions. A plurality of the lands and a plurality of the depressions include a through-hole extending through the screen plate.

18 Claims, 3 Drawing Sheets

PULPER WITH SCREEN PLATE HAVING MAXIMUM DEFIBERING EDGES

BACKGROUND OF THE INVENTION

1. Field of the Invention

The present invention relates to pulpers for a fiber suspension, and, more particularly, to pulpers having a screen plate for separating good fibers from effluent.

2. Description of the Related Art

A pulper is used for making fibers which are used in a fiber suspension in a paper-making machine. The source of fiber may be, e.g., wood fiber in the form of virgin fiber or recycled fiber. The pulper grinds the source of fiber into individual fibers which are used in the fiber suspension in a paper-making machine.

It is known to use a pulper with an extraction/screen plate and a rotor which are disposed within a vessel. For simplicity, the extraction/screen plate is referred to as a screen plate herein. The rotor causes the source of fiber to rotate past the screen plate. Good fiber passes through a plurality of holes in the screen plate for further processing, while undesirable substances such as foreign matter, etc., do not pass through the holes in a screen plate and may be discarded.

A screen plate is typically perforated or has other profiled perforations or slots. The surfaces of the screen plate are either flat or have various forms of surface projections, e.g., bars, strips, etc. The stationary projections work in conjunction with the leading edges of the rotating rotor vanes to break down flakes/knits and other undefibered materials in a slurry.

Strips and bars on a screen plate have the disadvantage that they reduce the available screening surface area and are therefore restricted in quantities to maintain the necessary open screening area/hydraulic through-put capacities. The process of applying the strips and bars typically requires high levels of heat (e.g., welding) resulting in warping and surface distortion to the plate, requiring additional work processes to return the plate surface to an acceptable level of flatness.

A screen plate may include holes which are formed directly in the screen plate, or the holes may be defined by inserts which are received within corresponding openings in the screen plate. The inserts may be removably or irremovably attached to the base plate of the screen plate, such as by arc welding. The inserts may extend above the level of the base plate, and the exposed edges of the inserts exert a shearing action on the fiber suspension. An example of a screen plate including inserts extending above a level of the base plate is disclosed in U.S. Pat. No. 6,254,729 (Doelle et al.) which is assigned to the assignee of the present invention.

For ease of manufacturing, inserts as described above are typically formed as short tube sections which are inserted into corresponding circular holes formed in the base plate. The exposed edges of the inserts thus provide a rounded leading edge which limits the amount of shearing action induced on the fiber suspension. Further, the time necessary to metalurgically bond the inserts to the base plate, such as by welding, increases the manufacturing costs of the screen plate. Moreover, material tends to accumulate on the screen plate in the area between the inserts since there are no holes in the base plate, other than the larger diameter openings in which the inserts are received.

What is needed in the art is a screen plate which provides a maximum available edge impacting surface profile without reducing the available screen plate area.

SUMMARY OF THE INVENTION

The present invention provides a screen plate for a pulper in which a series of intersecting grooves define a cross-hatched pattern of lands and depressions, with each land and depression having a hole formed therein. The raised blocks defined by the lands each have side edges, which depending upon the rotational direction of the rotor, provide maximum edge impacting surfaces in conjunction with the rotor vane leading edges.

The invention comprises, in one form thereof, a screening machine for a fiber suspension including a vessel; a rotor disposed within the vessel; and a screen plate positioned in stationary opposition to the rotor. The screen plate includes a plurality of substantially parallel first grooves extending in a first direction and a plurality of substantially parallel second grooves extending in a second direction. The first grooves intersect with the second grooves. The first grooves and the second grooves conjunctively define a plurality of lands and depressions. A plurality of the lands and a plurality of the depressions include a through-hole extending through the screen plate.

The invention comprises, in another form thereof, a screen plate for use in a screening machine. The screen plate includes a base plate having a working surface. The working surface includes a plurality of substantially parallel first grooves extending in a first direction and a plurality of substantially parallel second grooves extending in a second direction. The first grooves intersect with the second grooves, and the first grooves and second grooves conjunctively define a plurality of lands and depressions. A plurality of the lands and a plurality of the depressions include a through-hole extending through the screen plate.

The invention comprises, in yet another form thereof, a method of manufacturing a screen plate for use in a screening machine, including the steps of: forming a plurality of substantially parallel first grooves extending in a first direction in a base plate; forming a plurality of substantially parallel second grooves extending in a second direction in the base plate, whereby the first grooves intersect with the second grooves, the first grooves and the second grooves conjunctively defining a plurality of lands and depressions; and forming a plurality of through-holes extending through the screen plate, each through hole positioned in a respective one of the lands or depressions.

An advantage of the present invention is that the cross-hatch pattern of the lands and depressions provides a maximum edge impact relationship between the rotor vanes and screen plate surface profiling.

Another advantage is that the lands have defibering edges capable of achieving equal results, regardless of the direction of rotation of the rotor.

Yet another advantage is that the screen plate has a maximum available edge impacting surface profile with no reduction to the available screen plate open area.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplifications are not to be construed as limiting the scope of the invention in any manner.

DETAILED DESCRIPTION OF THE INVENTION

Figure 1:
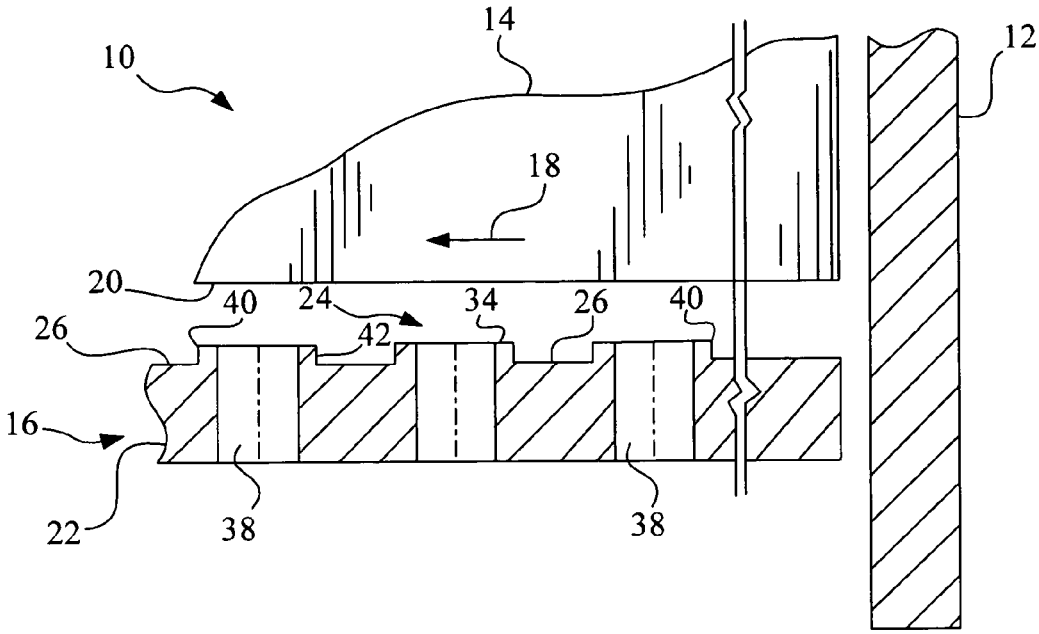
FIG. 1 is a fragmentary, side view of a pulper including an embodiment of a screen plate of the present invention.
Figure 2:
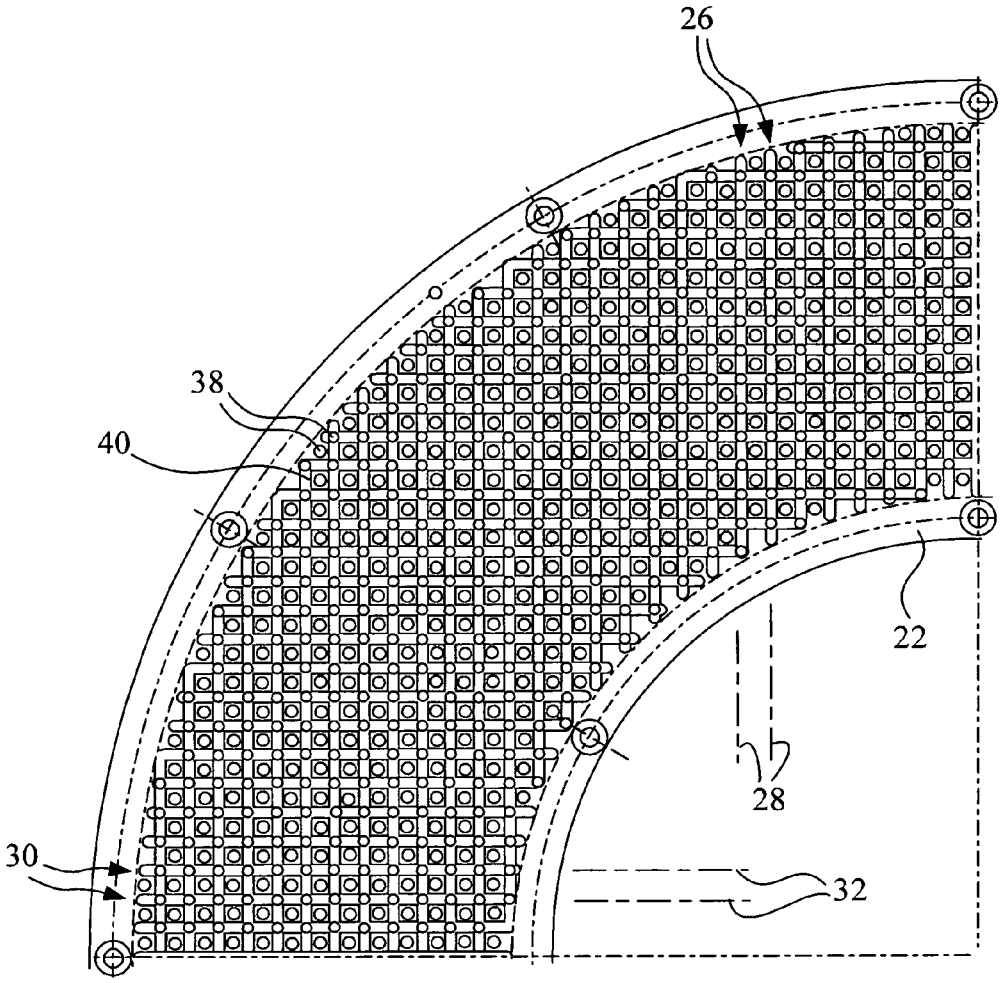
FIG. 2 is a plan view of a quadrant of the screen plate shown in FIG. 1.
Figure 3:
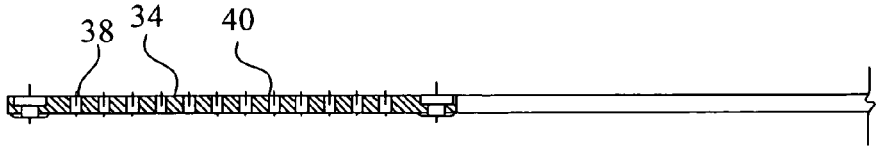
FIG. 3 is a side, sectional view showing half of the screen plate shown in FIGS. 1 and 2.
Figure 4:
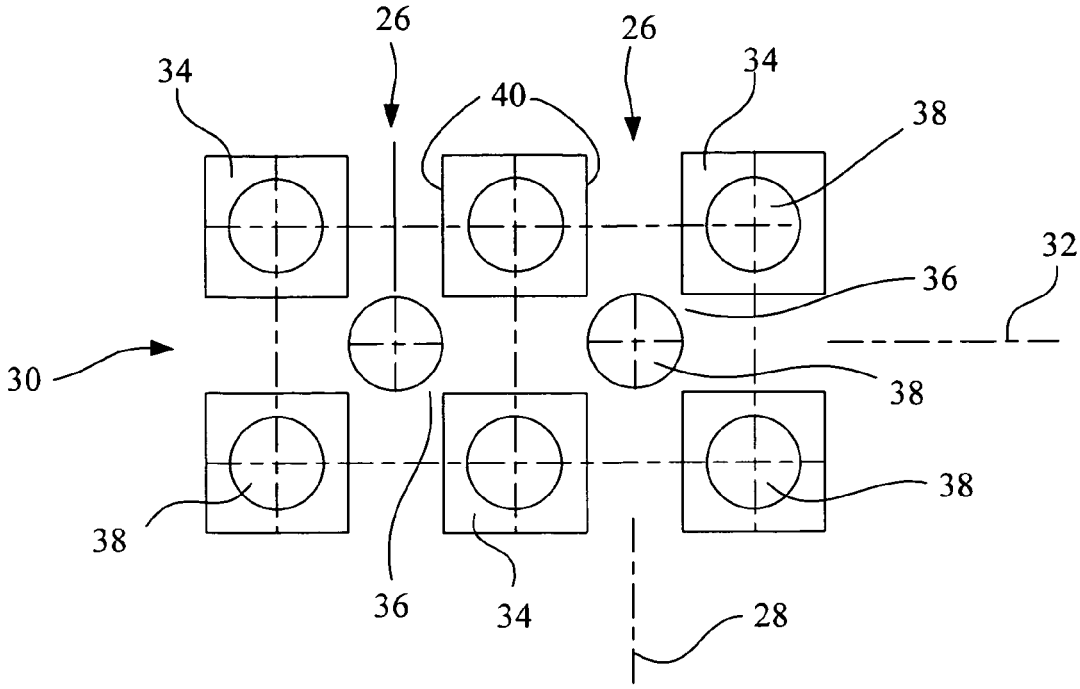
FIG. 4 is a plan view showing in more detail the hole pattern of the screen plate shown in FIGS. 1-3.
Figure 5:
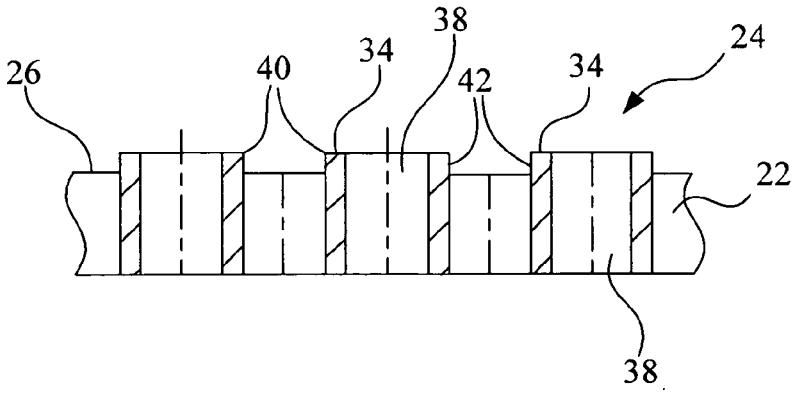
FIG. 5 is a side, sectional, composite view showing the projected hole pattern of the bottom two rows of holes in FIG. 4.

Referring now to the drawings, and more particularly to FIG. 1, there is shown an embodiment of a flat plate screening machine 10 of the present invention, which generally includes a vessel 12, rotor 14 and screen plate 16. In the embodiment shown in the drawings, flat plate screening machine 10 is assumed to be a pulper for purposes of illustration. However, it is to be understood that flat plate screening machine 10 may be any other type of machine which is used to process fiber or a fiber suspension, such as a fiber sorter or turbo separator.

Vessel 12 can be of any suitable configuration, such as a closed top or open top vessel. For ease of illustration, only one wall of vessel 12 is shown in FIG. 1.

Rotor 14 is disposed within vessel 12, and has a generally circular cross-section when viewed from the top of FIG. 1. When rotated in a clockwise direction as viewed from the top, a portion of rotor 14 closest to the plane of viewing in FIG. 1 moves from right to left, as indicated by arrow 18, and a portion adjacent to the illustrated side wall of vessel 12 moves in a direction toward the viewing plane of FIG. 1. Rotor 14 is shown with a smooth bottom surface 20 for ease of illustration, but likely includes a contoured surfaced or projections extending from bottom surface 20 which assist in inducing a circular flow of the fiber suspension between rotor 14 and screen plate 16.

Screen plate 16 is disposed within vessel 12, in stationary opposition to rotor 14. Screen plate 16 includes a base plate 22 defining a working surface 24 on a side facing rotor 14. Working surface 24 includes a plurality of substantially parallel first grooves 26 extending in a first direction 28 and a plurality of substantially parallel second grooves 30 extending in a second direction 32. First grooves 26 intersect with second grooves 30, defining a cross-hatched pattern of grooves. First grooves 26 and second grooves 30 conjunctively define a plurality of lands 34 and depressions 36. In the embodiment shown, first grooves 26 and second grooves 30 intersect generally orthogonal to each other, but may also intersect at a different angle, thus changing the frontal shape of lands 34 and depressions 36. More particularly, depending upon the intersection angle between first grooves 26 and second grooves 30, as well as the spacing between first grooves 26 and second grooves 30, lands 34 may have a shape which is square shaped, rectangular shaped or diamond shaped.

Lands 34 and depressions 36 are each formed with a through-hole 38 extending through base plate 22 of screen plate 16. In the embodiment shown, each land 34 is formed with a centrally located through-hole 38 and each depression 36 is formed with a centrally located through-hole 38. However, it is possible that not all lands 34 and/or depressions 36 include a through-hole 38. Moreover, the through-holes 38 need not be centrally located within respective lands 34 or depressions 36.

Each land 34 includes a plurality of defibering edges 40, each of which is a linear edge in the embodiment shown. The particular edge which is used as a leading edge, defibering edge depends upon the direction of rotation of rotor 14. Defibering edges 40 are substantially sharp defibering edges to induce a maximum fluid shear effect in the fiber suspension. To that end, a plurality of adjoining side walls 42 extend between lands 34 and depressions 36, generally orthogonal to a respective land 34. Side walls 42 could possibly be positioned at a slight acute angle relative to a respective land 34 to provide a slight undercut and even sharper defibering edge.

In the embodiment shown, each land 34 lies in a common plane and each depression 36 lies in another common plane. Lands 34 extend between approximately 0.1 and 0.2 inch above depressions 36, and preferably extend approximately 0.13 inch above depressions 36. Base plate 22 has a total thickness of approximately 0.87 inch (from the back side to lands 34), and a thickness from the back side to depressions 36 of approximately 0.75 inch. Each land 34 and each depressions 36 has a generally square shape of approximately 0.75 inch by 0.75 inch. Of course, these dimensions may vary depending upon the application.

During manufacture, the plurality of substantially parallel first grooves 26 extending in first direction 28 are formed in base plate 22. The plurality of substantially parallel second grooves 30 extending in second direction 32 are then formed in base plate 22, whereby first grooves 26 intersect generally orthogonal with second grooves 30. The plurality of through-holes 38 are then formed in screen plate 22, with each through-hole 38 centrally positioned in a respective land or depression.

Screen plate 16 is particularly suited for pulping applications requiring high levels of attrition. This would typically be in a batch or continuous pulping application where the constant stock recirculation/multiple edge impacting would have a rapid defibering effect. This effectively reduces defibering/pulping times and thereby creates significant specific energy savings.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A screening machine for a fiber suspension, comprising:

a vessel;

a rotor disposed within said vessel; and a screen plate positioned in stationary opposition to said rotor, said screen plate including a plurality of substantially parallel first grooves extending in a first direction and a plurality of substantially parallel second grooves extending in a second direction, said first grooves intersecting with said second grooves, each of said first and second grooves including a plurality of side walls, said first grooves and said second grooves conjunctively defining a plurality of lands and a plurality of depressions, said lands including a plurality of defibering edges, each of said lands and each of said depressions including a through-hole extending through said screen plate, the screening machine being a pulper.

2. The screening machine of claim 1, wherein said lands have a shape as viewed in a direction extending through said through-holes which is one of square shaped, rectangular shaped, and diamond shaped.

3. The screening machine of claim 1, wherein said lands have a generally square shape as viewed in a direction extending through said through-holes.

4. The screening machine of claim 1, wherein said lands have a substantially sharp said defibering edge.

5. The screening machine of claim 4, wherein said defibering edge is an orthogonal edge.

6. The screening machine of claim 1, wherein each said through-hole is centrally located in a respective one of said lands and said depressions.

7. The screening machine of claim 1, wherein said depressions lie in a common plane and said lands extend between approximately 0.1 and 0.2 inch above said depressions.

8. The screening machine of claim 7, wherein said lands extend approximately 0.13 inch above said depressions.

9. The screening machine of claim 1, wherein said screen plate is of a monolithic construction defining said lands and said depressions.

10. A screen plate for use in a screening machine, comprising:

a base plate of the screen plate having a working surface, said working surface including a plurality of substantially parallel first grooves extending in a first direction and a plurality of substantially parallel second grooves extending in a second direction, said first grooves intersecting with said second grooves, each of said first and second grooves including a plurality of side walls, said first grooves and said second grooves conjunctively defining a plurality of lands and a plurality of depressions, said lands including a plurality of defibering edges, a each of said lands and each of said depressions including a through-hole extending through said screen plate, the screen plate configured for being used in the screening machine which is a pulper and for being positioned in stationary opposition to a rotor.

11. The screen plate of claim 10, wherein said lands have a shape as viewed in a direction extending through said through-holes which is one of square shaped, rectangular shaped, and diamond shaped.

12. The screen plate of claim 10, wherein said lands have a generally square shape as viewed in a direction extending through said through-holes.

13. The screen plate of claim 10, wherein said lands have a substantially sharp said defibering edge.

14. The screen plate of claim 13, wherein said defibering edge is an orthogonal edge.

15. The screen plate of claim 10, wherein each said through-hole is centrally located in a respective one of said lands and said depressions.

16. The screen plate of claim 10, wherein said depressions lie in a common plane and said lands extend between approximately 0.1 and 0.2 inch above said depressions.

17. The screen plate of claim 16, wherein said lands extend approximately 0.13 inch above said depressions.

18. The screen plate of claim 10, wherein said screen plate is of a monolithic construction defining said lands and said depressions.

* * * * *